US006007269A

United States Patent [19]

Marinelli

[11] Patent Number: 6,007,269

[45] Date of Patent: Dec. 28, 1999

[54] OFFSET BLOCK AND SUPPORTING POST FOR ROADWAY GUARDRAIL

[75] Inventor: John Marinelli, 3407 Oak Alley Ct., Unit 503, Toledo, Ohio 43606

[73] Assignee: John Marinelli, Toledo, Ohio

[21] Appl. No.: 09/080,359

[22] Filed: Jan. 12, 1998

Related U.S. Application Data

[63] Continuation-in-part of application No. 08/744,547, Nov. 6, 1996, abandoned.

[51] Int. Cl.[6] ..... E01F 15/04

[52] U.S. Cl. ..... 404/6; 256/13.1; 52/DIG. 9

[58] Field of Search ..... 404/6, 9; 256/1, 256/13.1, 19; 52/DIG. 7, DIG. 8, DIG. 9

[56] References Cited

U.S. PATENT DOCUMENTS

| | | | |
|---|---|---|---|
| 2,088,087 | 7/1937 | Hudson . | |
| 3,603,562 | 9/1971 | Glaesener | 256/13.1 |
| 3,704,861 | 12/1972 | Glaesener | 256/13.1 |
| 3,963,218 | 6/1976 | Glaesener | 256/13.1 |
| 4,193,584 | 3/1980 | Wieser | 256/19 |
| 4,222,552 | 9/1980 | Matteo, Sr. | 256/13.1 |
| 4,330,106 | 5/1982 | Chisholm | 256/13.1 |
| 4,594,021 | 6/1986 | Schafer et al. | 404/14 |
| 4,678,166 | 7/1987 | Bronstad et al. | 256/13.1 |
| 4,784,515 | 11/1988 | Krage et al. | 404/6 |
| 5,203,543 | 4/1993 | Fleury | 256/13.1 |
| 5,286,136 | 2/1994 | Mandish et al. . | |
| 5,336,016 | 8/1994 | Baatz | 404/6 |
| 5,429,449 | 7/1995 | Baatz | 404/6 |

*Primary Examiner*—James A. Lisehora

[57] ABSTRACT

A roadway guardrail system including a longitudinally extending guardrail supported by an array of spaced apart vertically mounted supporting posts and associated offset block whereas the supporting posts and/or the offset blocks are I beam shaped members.

15 Claims, 2 Drawing Sheets

OFFSET BLOCK AND SUPPORTING POST FOR ROADWAY GUARDRAIL

This is a Continuation-In-Part application of U.S. patent application Ser. No. 08/744,547, filed Nov. 6, 1996, now abandoned.

BACKGROUND OF THE INVENTION

1. Field of the Invention

The invention relates to roadway guardrail systems and more particularly to an offset block and supporting post for supporting an associated guardrail.

2. Description of the Prior Art

Roadway guardrails are typically comprised of longitudinally extending sections of interconnected guardrails mounted to spaced apart vertically extending supporting posts. The supporting posts are spaced along the edge of a highway surface usually adjacent an intervening shoulder. Usually a mounting block is disposed between the guardrail and the supporting post. Such an arrangement is useful in spacing the guardrail from the supporting posts to minimize the likelihood of an impact between an impinging vehicle and the supporting posts. When there is a contact between a vehicle and the guardrail, especially in the region of a supporting post, the guardrail, due to its shape and composition, will absorb energy from the impinging vehicle. Thereby, the breakage of the supporting posts is minimized allowing the entire system to retain the vehicle in the right-of-way and prevent it from entering an adjacent ditch, field, or other undesired situs.

Guardrails, damaged by vehicular impact, may be readily replaced by removing the bolts which fasten the guardrails to the supporting posts through respective offset blocks. While considerable expense in both time and materials is experienced, the cost is less than the requirement to replace the entire system including the supporting posts.

The prior art guardrail systems typically employed supporting posts and offset block made of wood. Wooden supporting posts and offset blocks have some advantages. However, there are disadvantages to the use wood. Amongst the disadvantages are the wood has a limited service life and tends to constantly be depleting our forests.

It is an object of the present invention to produce a supporting post and offset block for guardrails which will be superior to wood.

Another object of the invention is to produce a supporting post and offset block for guardrails which have an unlimited duty cycle.

Another object of the invention is to produce a supporting post and offset block for guardrails formed of a composite material which is inert to the effect of the environment such as sunlight, heat, cold, rain, and snow.

SUMMARY OF THE INVENTION

The above as well as other objects of the invention may be readily achieved by a roadway guardrail system including a longitudinally extending guardrail, spaced apart vertically extending supporting posts and respective offset blocks for mounting the guardrail to respective ones of the supporting posts wherein the offset blocks are generally I beam shaped members.

BRIEF DESCRIPTION OF THE DRAWINGS

The above objects and advantages of the invention may be readily apparent to one skilled in the art from reading the following detailed description of an embodiment of the invention when considered in the light of the accompanying drawings, in which.

DETAILED DESCRIPTION OF THE PREFERRED EMBODIMENT OF THE INVENTION

Figure 1:
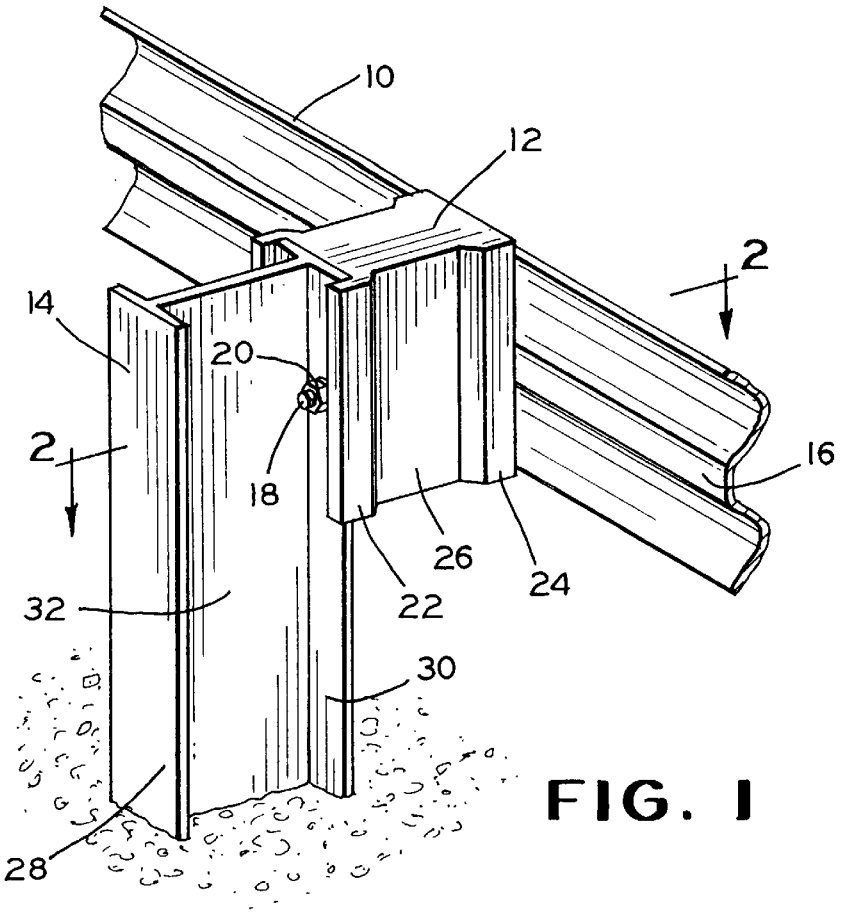
FIG. 1 is a fragmentary perspective view of a roadway guardrail system illustrating the utilization of an offset block in accordance with the present invention.

Referring to the drawings, there is disclosed a roadway guardrail system incorporating the features of the invention.

Figure 2:
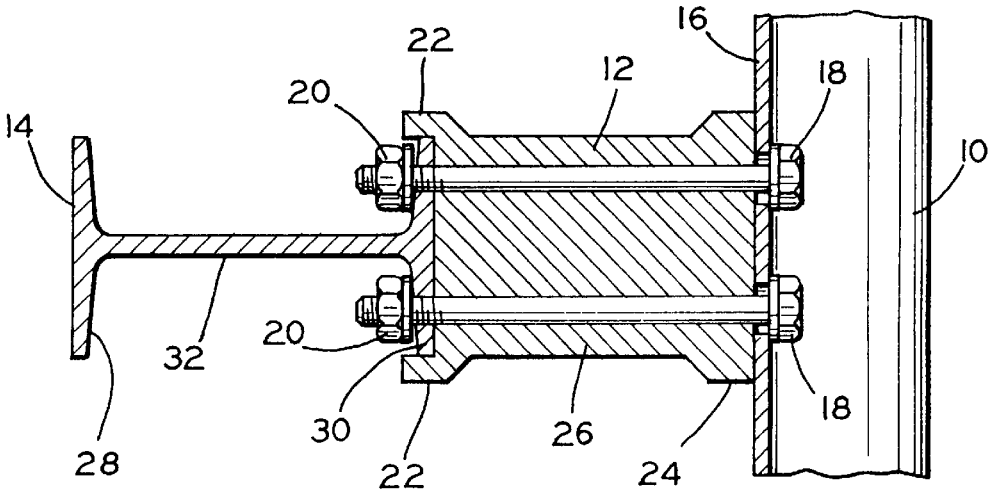
FIG. 2 is a sectional view of the system illustrated in FIG. 1 and taken along line 2—2 thereof.

FIGS. 1 and 2 show a guardrail 10 is of a conventional type having a uniform transverse W-shaped cross-section and is formed of galvanized heavy gauge metal, such as steel, for example, roll formed with generally rounded upper and lower edges. The guardrail 10 is typically connected to spaced apart supporting posts 14, one of which is illustrated, having a respective number of offset blocks 12 interdigitated between the upper portion of the supporting post 14 and the adjacent facing surface of the guardrail 10. The supporting posts 14 are in the form of an I beam formed of metal.

It will be appreciated that the guardrail 10 is provided with apertures formed in a central web 16 thereof, which apertures are aligned with an aperture formed in the offset block 12 and an aligned aperture in the support post 14. In assembling the elements of the guardrail system, when the above mentioned apertures are aligned, threaded fasteners such as bolts 18 are inserted and nuts 20 are installed and suitably tightened to complete the system.

The offset block 12 is also formed generally in the shape of an I beam having a pair of spaced apart flange sections 22 and 24 with an interconnecting center web section 26. The outermost face of the flange 22 is formed with a recessed section to receive the flange of the supporting post 14.

The supporting post 14 is formed with a similar cross-sectional configuration as the offset block 12. More specifically, the supporting post 14 has a cross-sectional shape of an I beam with spaced apart flange sections 28 and 30 and an interconnecting center web section 32. As pointed out above, the flange section 30 is received within the recessed section of the flange section 22 of the offset block 12 in the assembled condition.

Figure 3:
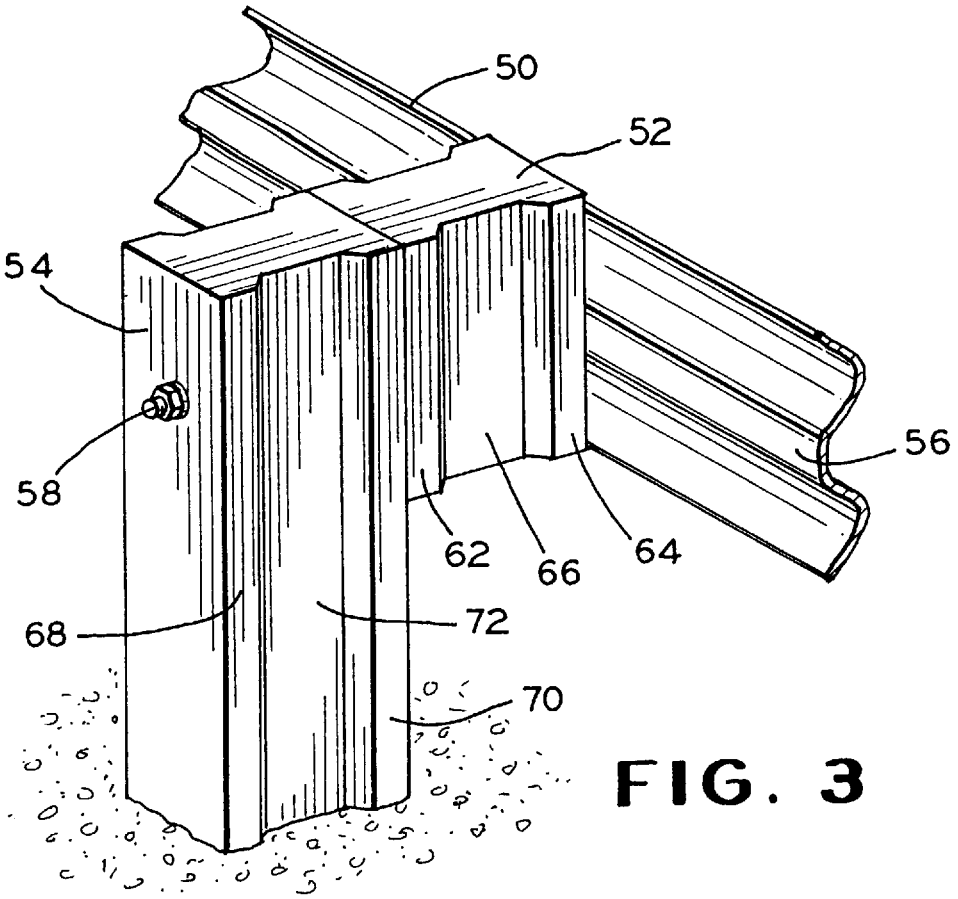
FIG. 3 is a fragmentary perspective view of a guardrail system wherein the offset block and the supporting post are made in accordance with the present invention.

Another embodiment of the invention is illustrated in FIG. 3 wherein there is disclosed a guardrail system including a guardrail 50 of a conventional type similar to that illustrated in FIGS. 1 and 2. The guardrail 50 is typically connected to spaced apart supporting posts 54, one of which is illustrated, having a respective number of offset blocks 52 interdigitated between the upper portion of the supporting post 54 and the adjacent facing surface of the guardrail 50. It will be noted that the supporting posts 54 are in the form of an I beam.

The offset block 52 is formed generally in the shape of an I beam having a pair of spaced apart flange sections 62 and 64 with an integral interconnecting center web section 66.

The supporting post 54 is formed with a similar cross-sectional configuration as the offset block 52. More specifically, the supporting post 54 has a cross-sectional shape of an I beam with spaced apart flange sections 68 and 70 and an interconnecting center web section 72.

The guardrail 50 is provided with an aperture formed in a central web 56 thereof, which aperture is aligned with aligned apertures formed in the offset block 52 and the supporting post 54. In assembling the elements of the guardrail system, a threaded fastener such as a bolt 58 is inserted through the aligned apertures and a nut is installed and suitably tightened to effect completion of the assembly.

It has been found that satisfactory results can be achieved by forming the stock for making the offset blocks 52 and the supporting posts 54 from a composite material made of recycled materials such as post consumer waste polyolefin, waste glass fibers, and scrapped rubber tires. It will be understood that other thermoplastic polymers and copolymers of polyethylene, polypropylene, and polyester may be used. Also, while mention has been made of glass fibers, other reinforcing fibers formed of plastic and/or metal may be used.

The fabrication of the product from which the offset block and supporting post are produced consists of introducing the following constituents to an extruder:

65% (±2%) recycled plastic

20% (±2%) crumb rubber from scrapped tires

15% (±1%) waste glass fibers

After the constituents are mixed together and are introduced into the heating zone of the extruder, the constituents are heated to approximately 300° F. Typically, the plastic materials will initially soften and then melt. At this stage, the mixture is extruded through a suitably shaped extrusion die to produce a continuous length of stock in the shape of an I beam.

After the extruded stock leaves the extruder, the molten plastic, which acts as the primary bonding agent, cools and firmly bonds the substituents into a unitary formed product. The continuous length product is then cut into the desired lengths. For example, the material to be used for supporting posts 14 are cut into two (2) meter lengths, while the material to be used as offset blocks 12 is cut into 361 millimeter lengths. It will be understood that the length of the supporting posts 14 is a function of the said conditions of the particular roadway. The overall dimensions for a typical offset block 12 include a height of 361 mm, a width of 140 mm, and a depth of 192 mm.

It is found to be desirable to form apertures and bore holes in the product to receive the threaded fasteners for assembly in guardrail systems at the place where the offset blocks 12 and supporting posts 14 are produced. Otherwise, the apertures or bore holes may be formed on the job site.

Figure 4:
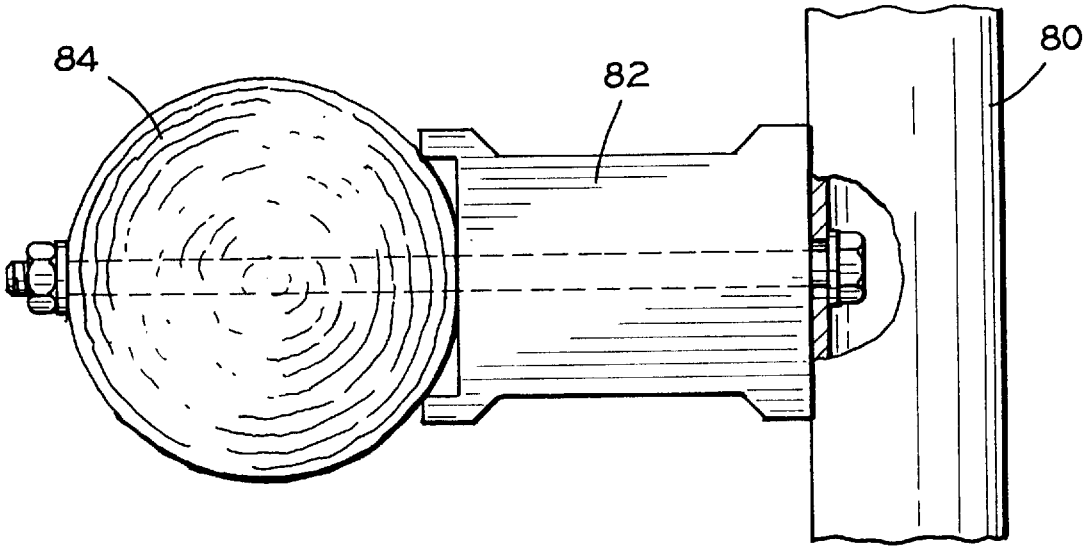
FIG. 4 is a fragmentary top plan view of another embodiment of the present invention utilizing the offset block of the present invention in combination with a guardrail and a wooden supporting post.

Another embodiment of the invention is illustrated in FIG. 4 wherein there is shown a guardrail 80, an associated offset block 82, and an associated supporting post 84. The supporting post 84 is formed from a wooden member of generally annular cross-section. It will be noted that the flange end of the offset block 82 is recessed in a manner similar to the offset block 12 of the embodiment illustrated in FIGS. 1 and 2. The configuration of the offset block 82 readily receives the outer peripheral wall of the supporting post 84 when the elements of the combination are assembled and drawn together in a secured operative condition by the nut and bolt arrangement shown in FIG. 4.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. An offset block for mounting a guardrail to a supporting post comprising: a generally I beam shaped member having opposed longitudinally extending parallel flange sections and an interconnecting coextensive center web of smaller width dimension that the width dimensions of the flange sections, said member being formed of a composite of 65% recycled plastic, 20% crumb rubber, and 15% reinforcing fibers.

2. An offset block as defined in claim 1 wherein said plastic is selected from a group of thermoplastic materials.

3. An offset block as defined in claim 2 wherein said group of thermoplastic materials include polyethylene, polyester, or polypropylene resins.

4. An offset block as defined in claim 1 wherein said reinforcing fibers are selected from a group of glass, metal or polymer fibers.

5. An offset block as defined in claim 4 wherein said fibers are formed from recycled material.

6. A supporting post for mounting a guardrail comprising:

a generally I beam shaped member having opposed longitudinally extended parallel flange sections and an interconnecting coextensive center web of smaller width dimension than the width dimension of the flange section, said member being formed of a composite of 65% recycled plastic, 20% crumb rubber, and 15% reinforcing fibers.

7. A supporting post as defined in claim 6 wherein said plastic is selected from a group of thermoplastic materials.

8. A supporting post as defined in claim 7 wherein said group of thermoplastic materials include polyethylene, polyester, or polypropylene resins.

9. A supporting post as defined in claim 6 wherein said reinforcing fibers are selected from a group of glass, metal, or polymer fibers.

10. A supporting post as defined in claim 9 wherein said fibers are formed from recycled material.

11. A roadway guardrail system including a longitudinally extending guardrail, spaced apart vertically extending supporting posts, and respective offset blocks for mounting the guardrail to respective ones of the supporting posts, the improvement comprising the offset blocks being generally I beam shaped with opposed longitudinally extending parallel flange sections of substantially the same width dimension, and an interconnecting coextensive center web section of smaller width dimension than the width dimension of the flange sections, wherein said offset block is formed of 65% recycled plastic, 20% crumb rubber from scrapped tires; and 15% waste glass fibers.

12. A roadway guardrail system as defined in claim 11 wherein said guardrail, supporting posts, and respective offset blocks are interconnected.

13. A roadway guardrail system as defined in claim 12 wherein said guardrail, supporting posts and respective offset blocks are coupled together by threaded fasteners.

14. A roadway guardrail system as defined in claim 11 wherein said supporting posts are generally I beam shaped with opposed longitudinally extending parallel flange sections of substantially the same width dimension, and an interconnecting coextensive center web.

15. A roadway guardrail system as defined in claim 11 wherein at least one of the flange sections of said offset blocks is provided with a recessed outer surface for receiving respective ones of the supporting posts.

* * * * *